US006234713B1

(12) United States Patent
Rowe et al.

(10) Patent No.: US 6,234,713 B1
(45) Date of Patent: May 22, 2001

(54) VIBRATOR TRUSS ASSEMBLY

(75) Inventors: Murray A. Rowe, Canton; Frederick A. Blom, Worthing; Dean A. Johnson, Canton, all of SD (US)

(73) Assignee: CMI Corporation, Oklahoma City, OK (US)

( * ) Notice: Subject to any disclaimer, the term of this patent is extended or adjusted under 35 U.S.C. 154(b) by 0 days.

(21) Appl. No.: 09/364,401

(22) Filed: Jul. 30, 1999

(51) Int. Cl.[7] ..... E01C 19/38
(52) U.S. Cl. ..... 404/116; 404/113
(58) Field of Search ..... 404/116, 118, 404/115, 113

(56) References Cited

U.S. PATENT DOCUMENTS

| | | | |
|---|---|---|---|
| 2,148,214 | 2/1939 | Mall . | |
| 2,261,659 | 11/1941 | Pierce . | |
| 2,744,456 | 5/1956 | Mittelstadt . | |
| 3,753,621 | 8/1973 | Dale . | |
| 4,128,359 | 12/1978 | Cooper, Jr. et al. . | |
| 4,256,415 | 3/1981 | Rowe et al. . | |
| 4,314,773 * | 2/1982 | Allen | 404/116 |
| 4,320,987 | 3/1982 | Rowe et al. . | |
| 4,775,262 | 10/1988 | Guntharp et al. . | |
| 4,993,369 | 2/1991 | Ulmer et al. . | |
| 5,492,432 | 2/1996 | Eben et al. . | |
| 5,791,815 | 8/1998 | Rowe . | |
| 5,988,939 * | 11/1999 | Allen et al. | 404/116 |

* cited by examiner

*Primary Examiner*—Thomas B. Will
*Assistant Examiner*—Raymond V Addie
(74) *Attorney, Agent, or Firm*—Emrich & Dithmar

(57) ABSTRACT

A vibrator assembly is described for use with a concrete paving machine moveable longitudinally along a body of poured concrete. The paving machine includes a machine frame and a finishing carriage unit moveable transversely back and forth across the body of concrete. A plurality of support members are mounted to the paving machine frame and include extension members structurally arranged to move between a collapsed position and an extended position. A vibrator truss support frame member is mounted to the extension members and a ganged vibrator carriage assembly is mounted to the vibrator truss support frame member and structurally arranged to move transversely back and forth across and through the body of concrete.

8 Claims, 8 Drawing Sheets

FIG. 11
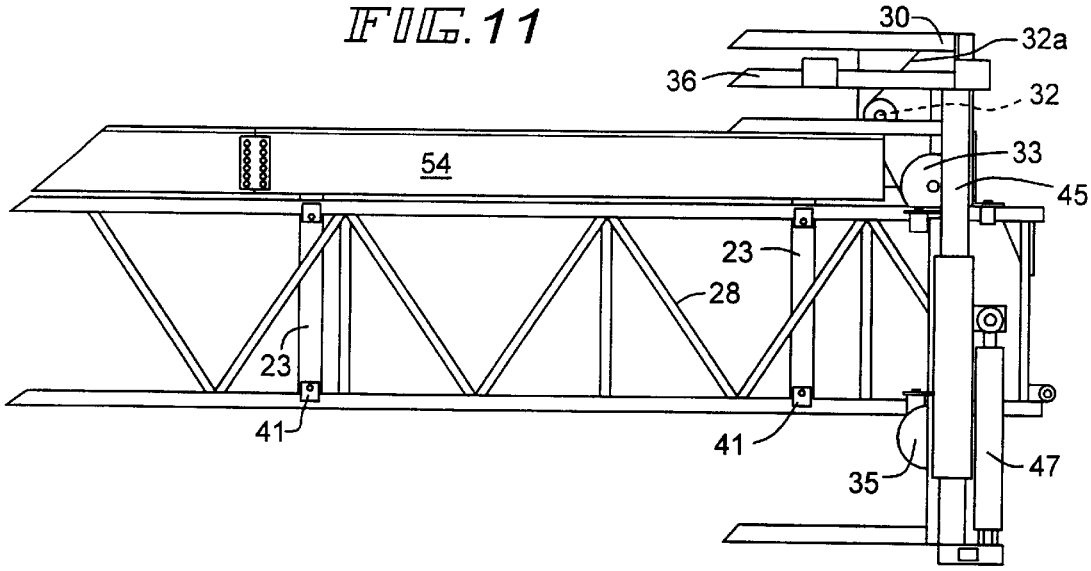
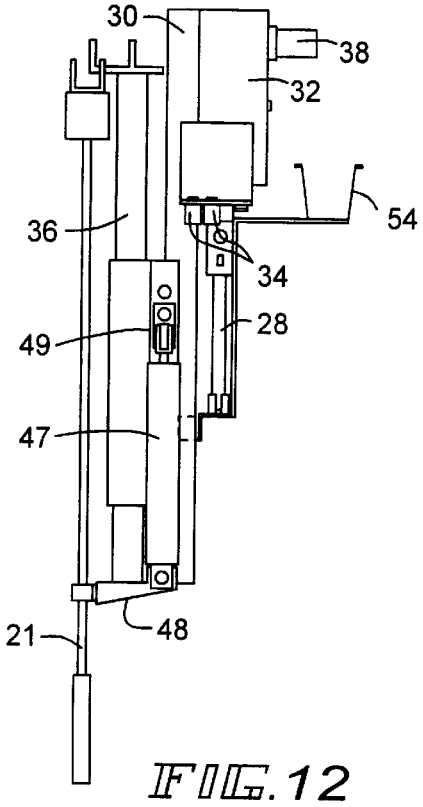
FIG. 12
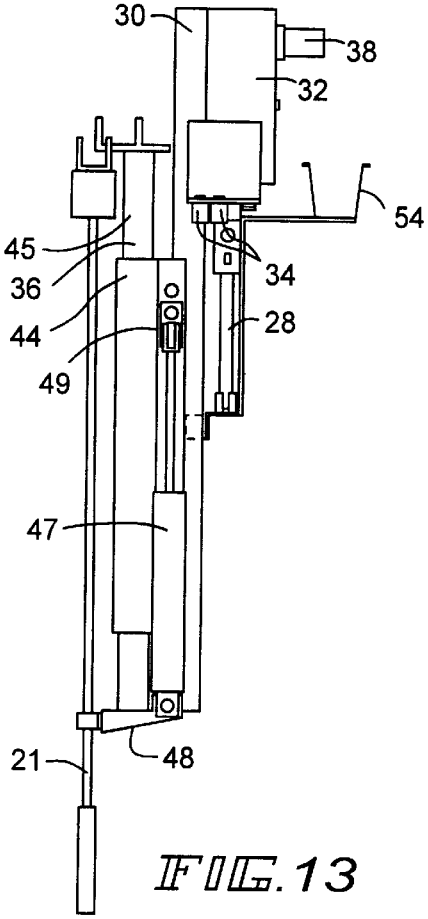
FIG. 13

50
50
T
P
58
27
27
47
47

VIBRATOR TRUSS ASSEMBLY

BACKGROUND OF THE INVENTION

The present invention relates to a concrete paving machine having ganged vibrators traveling on a mounted traversing truss frame that is adjustable to be positioned forwardly of the frame of the concrete paving machine.

It has been suggested that a plurality of ganged vertical mounted vibrators may be secured to a concrete paving machine frame to engage the concrete ahead of the concrete finishing unit to vibrate the concrete prior to finishing. In such assemblies, the ganged vibrators travel back and forth across the poured concrete and engage the poured concrete. However, such assemblies are adapted to be suspended from a truss assembly rigidly mounted to the paving machine frame. Accordingly, such assemblies have not been commercially acceptable for several reasons.

First, the weight of the powered ganged vibrator carriage assembly secured to the concrete machine frame causes the concrete paving machine frame to move vertically up and down as the carriage unit with the ganged vibrators traverses back and forth across the poured concrete surface. This up and down movement of the concrete paving machine frame produces an uneven finished concrete resulting in the failure of the paving machine to maintain a proper profile for the finished concrete surface.

Secondly, the back and forth movement across the concrete surface of the heavy duty power source necessary to power the ganged vibrators enhances the vertical up and down movement of the concrete leveling machine frame. Such up and down distortion further exacerbates the improper profile of the finished concrete surface.

Thirdly, the rigid mounting of the ganged vibrator assembly to the concrete paving machine frame results in a structure that must be assembled for usage at the job site and which must be disassembled after usage for transportation to another job site. Accordingly, such assemblies have found only limited usage.

SUMMARY OF THE INVENTION

The object of the present invention is to provide a novel concrete paving machine having a ganged vibrator assembly that traverses back and forth across a poured concrete surface without effecting the predetermined profile of the finished concrete.

A further object of the present invention is to provide a novel concrete paving machine which includes a ganged concrete vibrating apparatus mounted to a truss support assembly which may be adjustably positioned forwardly relative to the concrete paving machine frame.

Another object of the present invention is to provide a novel concrete paving machine having a ganged vibrating apparatus which moves through the concrete to be vibrated in a direction laterally of the roadway or deck on which the concrete is being leveled and finished and wherein the ganged vibrating apparatus may selectively be raised and lowered into the body of the concrete in a novel and expeditious manner.

Still a further object of the present invention is to provide a concrete paving machine having a ganged vibrator carriage assembly which moves back and forth laterally across the poured concrete without causing the frame of the concrete paving machine to deviate or distort by vertically moving up and down to thereby maintain a predetermined profile for the finished concrete surface.

Yet another object of the present invention is to provide a concrete paving machine having a ganged vertical vibrator assembly adapted to travel on a traversing frame containing the power source necessary for powering in the ganged vertical vibrator assembly back and forth across the poured concrete without distorting the desired and predetermined profile of the finished concrete that has been set by the paving machine.

Still another object of the present invention is a novel concrete paving machine which stores the vertical vibration frame and unit in a collapsed position to provide portability of the paving machine between job sites.

Yet another object of the present invention is a novel paving machine which adjustably mounts and projects a ganged vibrator assembly and traversing frame forwardly of the carriage finishing unit.

The present invention relates to a concrete paving machine having a ganged vertical vibrator assembly which is moveable on a traversing frame which is adjustably positioned forwardly of the frame of the concrete paving machine. The concrete finishing machine includes a finishing carriage unit engagable with the surface of the concrete and movable transversely across the body of the concrete. Specifically, the ganged vertical vibrator assembly includes a vibrator truss support member frame that is telescopically mounted to the frame of the concrete paving machine. The truss support member frame may be extended forwardly of the concrete paving machine when it is desired to vibrate the concrete and the truss support member frame is retractable to a position adjacent the frame of the concrete paving machine when it is necessary to transport the concrete paving machine between job sites. The ganged vibrating assembly is adapted for movement between a downwardly position wherein the ganged vibrator unit extends into and below the surface of the concrete and an upwardly position wherein the ganged vibrator unit is above the surface of the concrete.

In the present invention, the frame of the concrete paving machine is structurally arranged to accommodate the weight of the finishing carriage unit as it traverses back and forth across the deck or concrete slab to maintain a predetermined profile to the finished concrete. Thus, the distortion of the concrete paving machine frame is minimized during concrete leveling and finishing. The attachment of a ganged vibrating assembly to the concrete paving machine frame is taken into account and the paving machine is set to maintain the desired profile to the finished concrete. Accordingly, the mounting of the truss support assembly to the concrete paving frame and the mounting of the ganged vibrator assembly to the machine frame structurally maintains the predetermined grade or profile desired during the finishing operation across the entire deck or concrete surface.

Other and additional objects of the present invention will be apparent from the following description and claims and are illustrated in the accompanying drawings which, by way of illustration, show a preferred embodiment of the present invention and the principles thereof and what is now considered to be the best mode contemplated in applying those principles. Other embodiments of the present invention employing the same or equivalent principles may be used and structural changes may be made as desired by those skilled in the art without departing from the present invention and the scope of the appended claims.

BRIEF DESCRIPTIONS OF THE DRAWINGS

The foregoing description and other characteristics, objects, features and advantages of the present invention will become more apparent upon consideration of the following detailed description, having references to the accompanying drawings, wherein:

FIG. 11 is a partial rear view of the ganged vibrator carriage assembly illustrating the hose trough for facilitating the delivery of hydraulic fluid to the hydraulic motors and cylinders associated with the ganged vibrator carriage assembly in accordance with the present invention;

FIG. 12 is a side view of the ganged vibrator carriage assembly showing the ganged vibrator in the upward disengaged position;

FIG. 13 is a side view of the ganged vibrator carriage assembly showing the ganged vibrator in the lowered engaged position in the concrete.

DETAILED DESCRIPTION OF A PREFERRED EMBODIMENT

Figure 1:
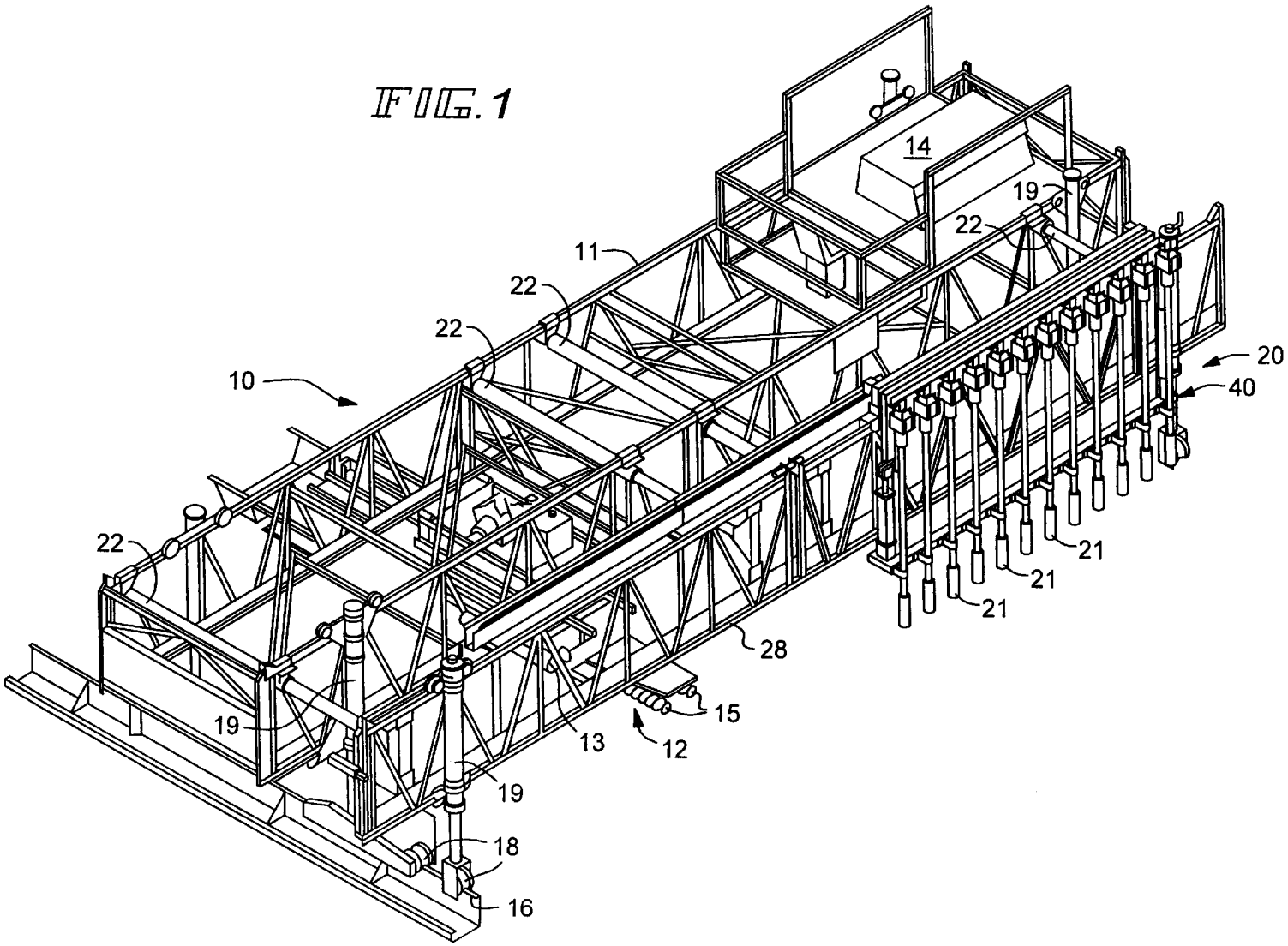
FIG. 1 is a front perspective view of a concrete paving machine embodying the principles of the present invention, with the machine including the ganged vibrator carriage assembly as an integral part thereof and disposed in operating position over a deck or a roadway surface.

The concrete finishing or paving machine 10 embodying the principles of the present invention is shown in the drawings when disposed in operating position over a poured, deck or concrete roadway. The concrete paving machine is of the type disclosed in U.S. Pat. No. 4,320,987, which patent is assigned to CMI Corporation, the assignee of the present invention.

Referring now to the drawings wherein like numerals have been used throughout the several views to designate the same or similar parts, there is illustrated in FIG. 1 a concrete finishing or paving machine 10 which includes an elongated trusswork or paving machine frame 11 on which is mounted a carriage finishing unit 12. The carriage finishing unit 12 is moveable longitudinally with respect to the paving frame 11. A control console 14 is mounted on the paving machine frame 11 from which an operator controls the operation of the paving machine 10. The paving frame 11 is adapted to extend transversely of the roadway or deck being finished and the paving machine 10 is adapted to be moved lengthwise of the roadway or deck in a direction transverse to the length of the paving frame 11. In the concrete paving machine 10 shown in FIG. 1, horizontal extending rails or supports 16 (only one is shown in FIG. 1) are positioned on opposite sides of the roadway or deck and extend lengthwise, with the upper edges of the rails 16 being adapted and structurally arranged to receive a pair of bogies 18 (only one is shown in FIG. 1) and a pair of bogies mounted on the opposite ends of the frame 11 (not shown), to enable the paving machine to move along the rails 16. The bogies 18 are each attached to support legs 19 on the machine 10, generally positioned in each corner of the machine, which are vertically adjustable relative to the rails by suitable crank means for adjusting the proper height of the finishing unit relative to the surface to be paved.

The finishing carriage unit 12 is mounted on and suspended from the paving frame 11 and includes an elongated concrete cylinder member or members 13 (only one is shown in FIG. 1) journaled and suspended from the carriage unit and moveable therewith. Additionally, a pair of screws or augers 15 are disposed forwardly of the cylinder members 13. The screws or augers are structurally arranged that during operation of the paving machine, the augers are rotated in such a direction that the engaged concrete tends to move towards the space between the auger members and outwardly from the elongated cylinders 13 until the finishing operation is accomplished, as is known in the art.

In accordance with the present invention, the paving frame 11 of the concrete paving machine 10 is structurally determined to accommodate the weight of the surfacing carriage unit as it traverses back and forth across the poured deck or concrete slab. Accordingly, the deviation or distortion resulting in the up and down movement of the paving frame caused by the back and forth movement of the finishing carriage unit 12 across the paving frame during the concrete leveling and finishing operation is compensated for and taken into account when setting the desired profile required when operating the paving machine. Thus, the back and forth movement of the carriage unit as it engages and finishes the concrete slab or poured deck does not effect the predetermined or desired profile of the finished concrete.

As shown in FIGS. 1–4, the present invention includes the mounting of a ganged vibrator carriage assembly 20 for use in conjunction with the concrete paving machine 10. The ganged vibrator carriage assembly 20 is comprised of a plurality of outer leg support members 22 which are secured to the paving frame 11. The outer leg support members 22 mounted to the paving frame 11 include an inner leg support member 24 which is axially moveable relative to the outer leg support members 22. As shown in the drawings, the inner leg support member 24 is axially supported with respect to the outer leg support member 22 and structurally arranged for a telescoping movement therebetween from an at rest position adjacent the paving frame 11 to an extended position forwardly of the paving frame. The inner leg support member 24 includes an adjusting nut 25 at the proximate end 24*a* thereof which cooperates with an adjusting screw 26, mounted within the outer leg support member 22, that is coupled to a hydraulic leg motor 27 (FIG. 4) which drives the inner leg member between the at rest and extended positions relative to the paving frame 11.

In accordance with the present invention, it is preferred that each of the outer leg support members mounted to the end of machine frame 11 may include an hydraulic leg motor, with the two remaining center mounted outer leg support members permitting a sliding movement of the inner leg to the extended position. Also, it is within the scope of the present invention that the adjusting screw may be manually driven and rotated to move the inner leg members between the at rest and extended positions.

Figure 3:
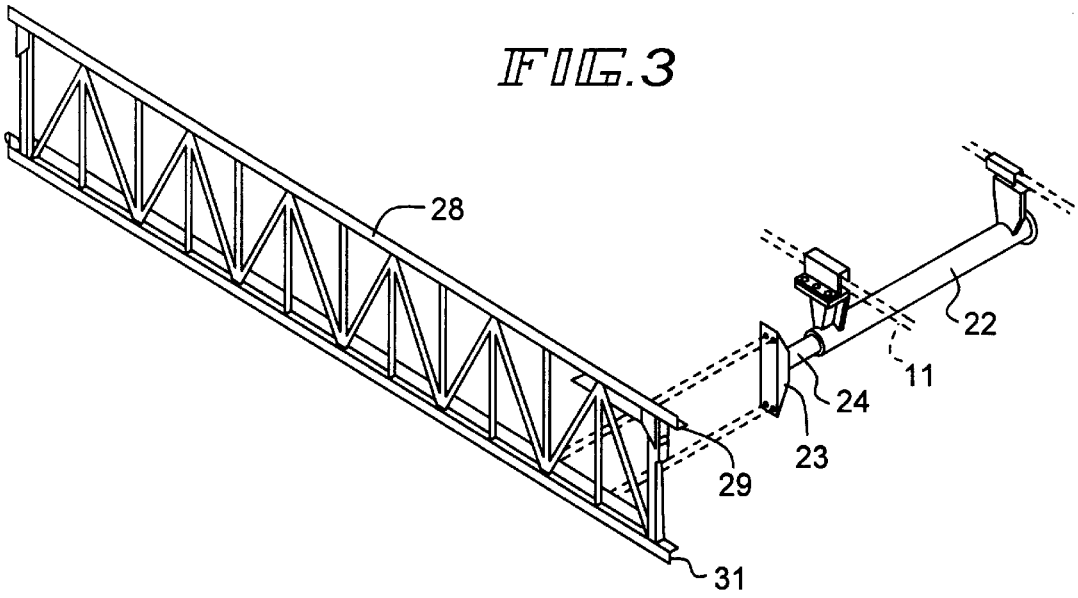
FIG. 3 is a perspective view showing the attachment of the truss support frame to the telescoping leg extension in accordance with the present invention.
Figure 3A:
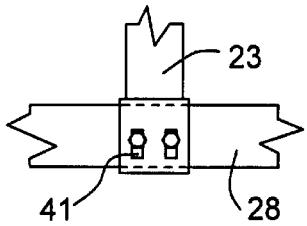
FIG. 3A is an enlarged view of the slotted mounting clamp for securing the truss support member frame to the inner leg support member in accordance with the present invention.
Figure 4:
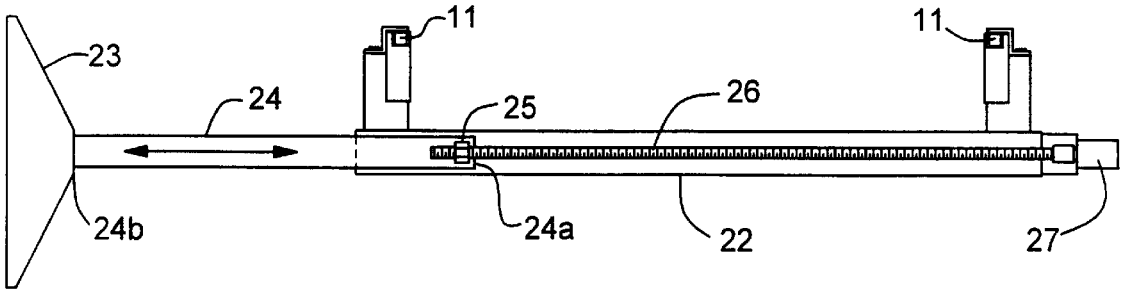
FIG. 4 is a cross-sectional view of the telescoping leg extension which is mounted to the concrete paving frame in accordance with the present invention.
Figure 6:
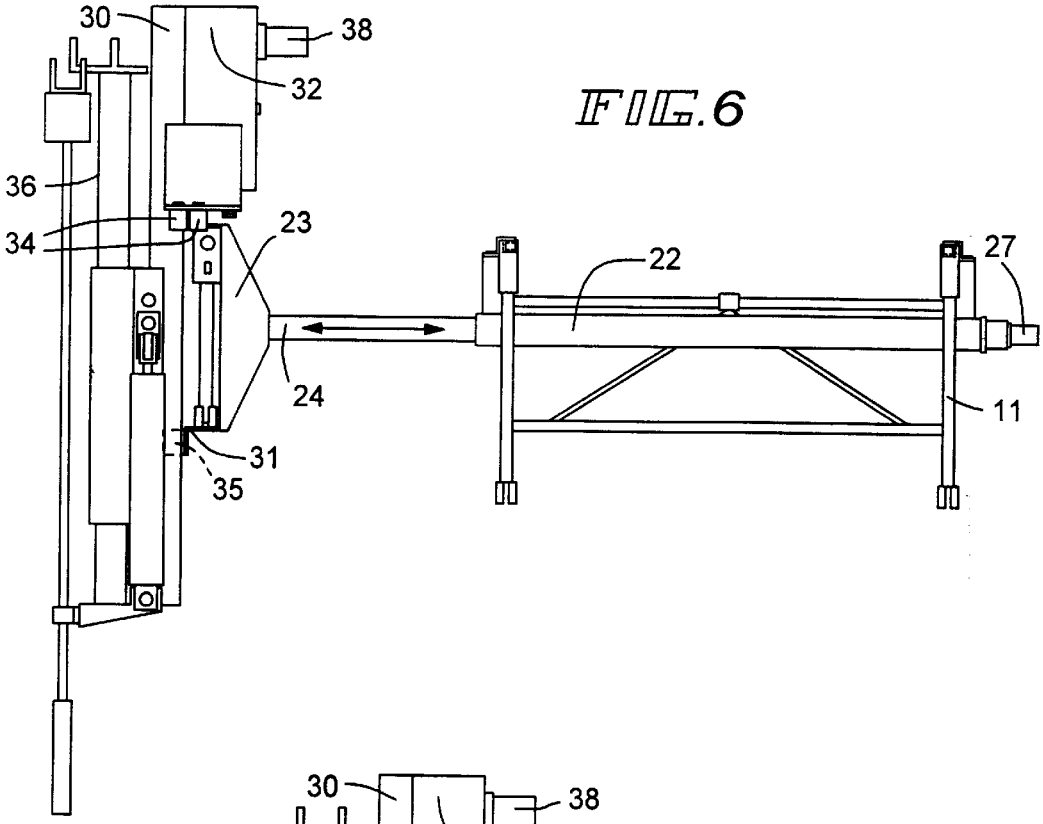
FIG. 6 is a cross-sectional view illustrating the extended operating position of the telescoping leg extension with the truss support assembly and the ganged vibrator carriage assembly mounted thereto in accordance with the present invention.
Figure 5:
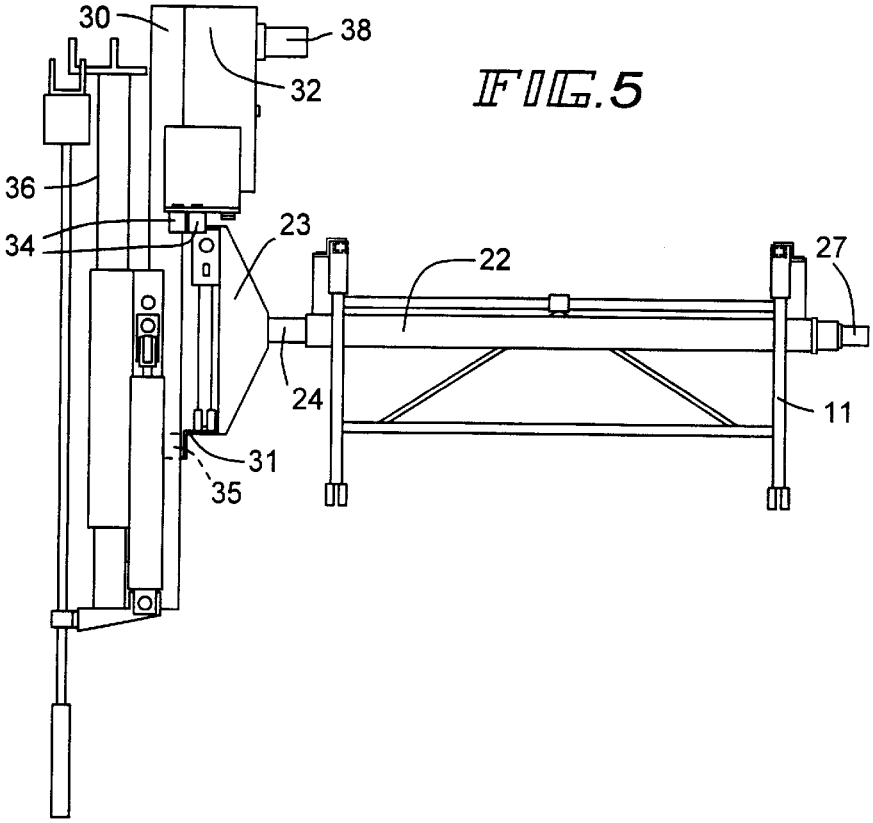
FIG. 5 is a cross-sectional view illustrating the telescoping leg extension in the fully retracted position, with the truss support assembly and ganged vibrator carriage assembly mounted thereto in accordance with the present invention.
Figure 7:
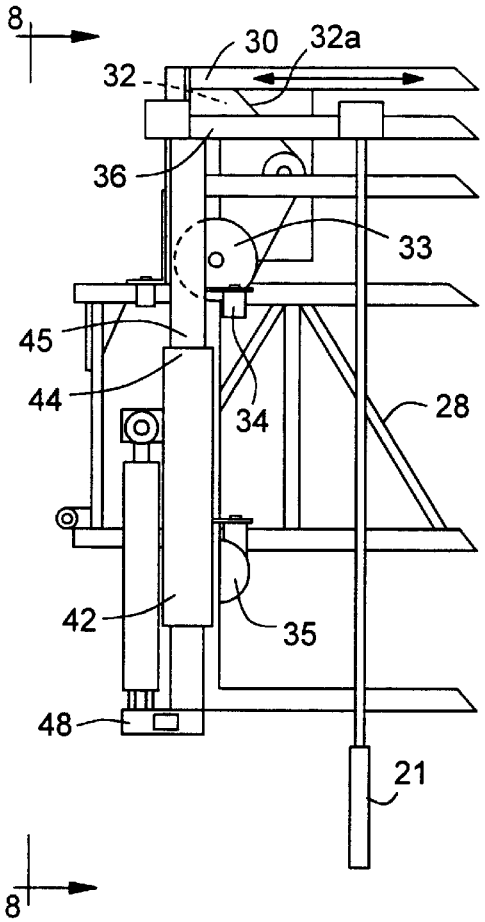
FIG. 7 is a partial front view of the left hand side of the ganged vibrator carriage assembly mounted to the truss support assembly in accordance with the present invention.
Figure 8:
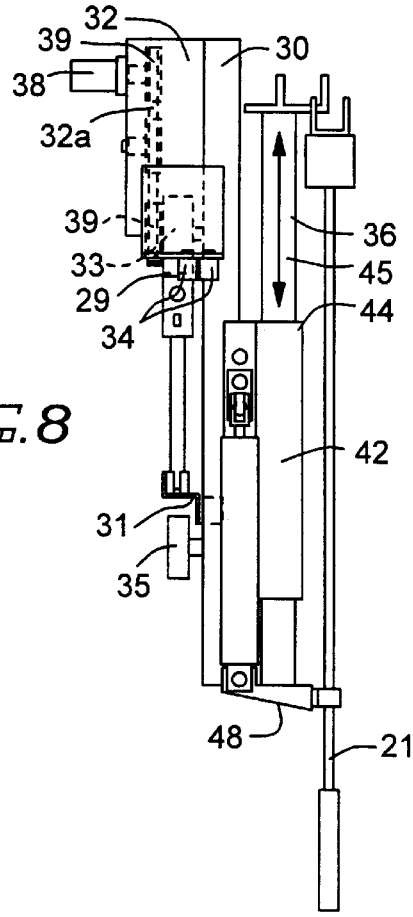
FIG. 8 is an end view of the ganged vibrator carriage assembly and truss support assembly shown in FIG. 7 taken along lines 8—8.
Figure 9:
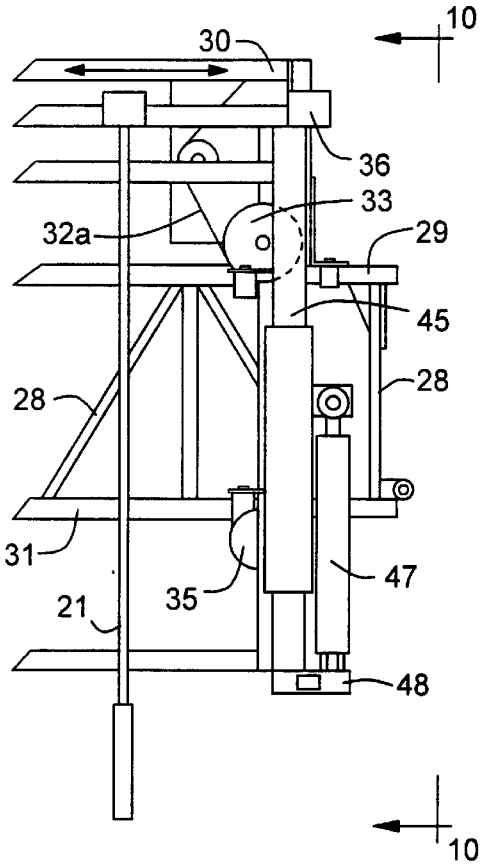
FIG. 9 is a partial front view of the right hand side of the ganged vibrator carriage assembly mounted to the truss support assembly in accordance with the present invention.
Figure 10:
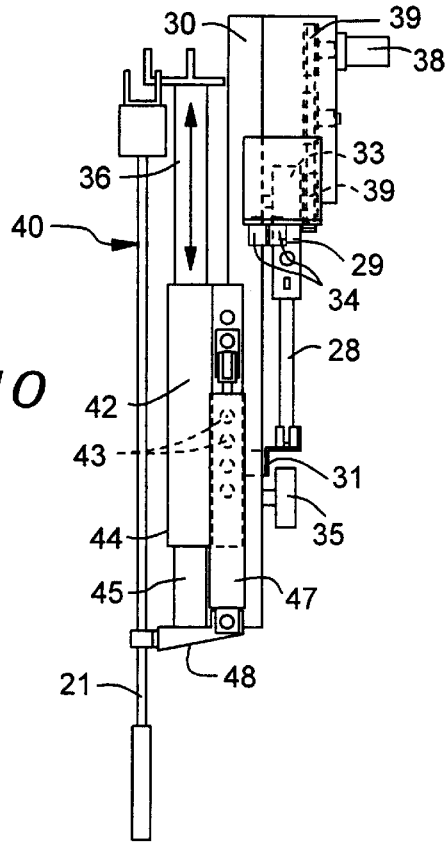
FIG. 10 is an end view of the ganged vibrator carriage assembly and truss support assembly taken along lines 10—10 of FIG. 9.

The distal end 24*b* of the inner leg support members 24 includes a bracket member 23 which is structurally arranged to engage and support the vibrator truss support member frame 28, which extends substantially across the width of the paving machine. The vibrator truss support member frame 28 is adjustably mounted to the bracket member 23 by a slotted clamp 41 (FIG. 3A) and fastening means on the distal end of inner leg members 24 which permits the telescoping inner leg extension members 24 to position the truss support member frame forwardly of the paving frame 11. The slotted clamp permits the minor adjustment of the truss support frame 2*b* with respect to the paving frame 11 to facilitate achieving the proper profile to the concrete slab. As shown in FIG. 1, four leg support members are mounted to the paving frame 11 to mount and position the truss support member frame 28 with respect to the paving frame 11. Also, the truss support member frame probably includes support legs 19 having a bogie 18 thereon which engage rail 16 (FIG. 1).

Mounted to the vibrator truss support member frame 28 is an inner vibrator frame member 30. As shown in the drawings, the inner vibrator frame member 30 includes two drive assemblies 32 at each corner thereof. As shown in FIGS. 5–13, the drive assemblies 32 are operatively connected by a drive chain 32*a* to a drive wheel 33 mounted on the inner vibrator frame member 30 which is structurally arranged to engage the L-shaped upper edge 29 of the vibrator truss support member 28 and to power the inner vibrating frame member 30 back and forth along the support member 28, as will hereafter be described. The inner frame member 30 includes also a pair of guide rollers 34 which are spaced apart and adapted to straddle the L-shaped upper edge 29 of the vibrator truss support member to maintain the inner frame member and the truss support member frame 28. This permits the inner vibrator frame member 30 to travel back and forth on the inner truss support member 28. Additionally, the inner vibrating frame member 30 includes a secondary guide roller 35 which is structurally arranged to engage the L-shaped lower edge 31 of the vibrator truss support member 28 to complete and maintain the proper tracking of the inner vibrator frame member 30 and the ganged vibrator carriage assembly 20 back and forth across the vibrator truss support member frame 28.

As described above, the inner vibrating frame member 30 is driven by a pair of hydraulic motors 38 each located at each corner of the inner vibrator frame. The motors 38 are operatively connected through a plurality of gears 39 to selectively drive and power drive wheel 33 (FIGS. 7 and 9) of the inner vibrator frame to achieve the back and forth movement across the truss support frame 28. The two hydraulic motors 38 are operatively connected to the inner vibrator frame and structurally arranged that after each path of travel across the vibrator truss support member, engagement with a stop member (not shown) causes one hydraulic motor to cease operation and energizes the other motor to power the ganged vibrator carriage assembly back across the paving frame.

An outer vibrator frame member 36 is structurally arranged to be mounted to the inner vibrator frame member 30 through a bracket member 42. The plurality of openings 43 in the bracket member and on the inner vibrator frame member 30 permit the adjustable mounting of the outer vibrator frame member with respect to the inner vibrator frame member. The bracket member includes a collar portion 44 which permits the vertical tube ends 45 of the outer vibrator frame 36 to slidably move between a lowered position wherein the ganged vibrators 21 engage the concrete (FIG. 13) to an upper position wherein the ganged vibrators are removed from the concrete (FIG. 12). The outer vibrator frame member 36 is coupled to one end 48 of a hydraulic cylinder 47 with the other end 49 of the hydraulic cylinder secured to the inner vibrator frame 30. Thus, hydraulic cylinders 47 are mounted at each end of the vibrator carriage assembly 20. Upon actuation, the hydraulic cylinders 47 are moveable between a upper disengaged position (FIG. 12) wherein the vibrators are removed from the concrete to a downward engaged position (FIG. 13) wherein the vibrators are engaged with the surface of the concrete to vibrate the same.

Figure 2:
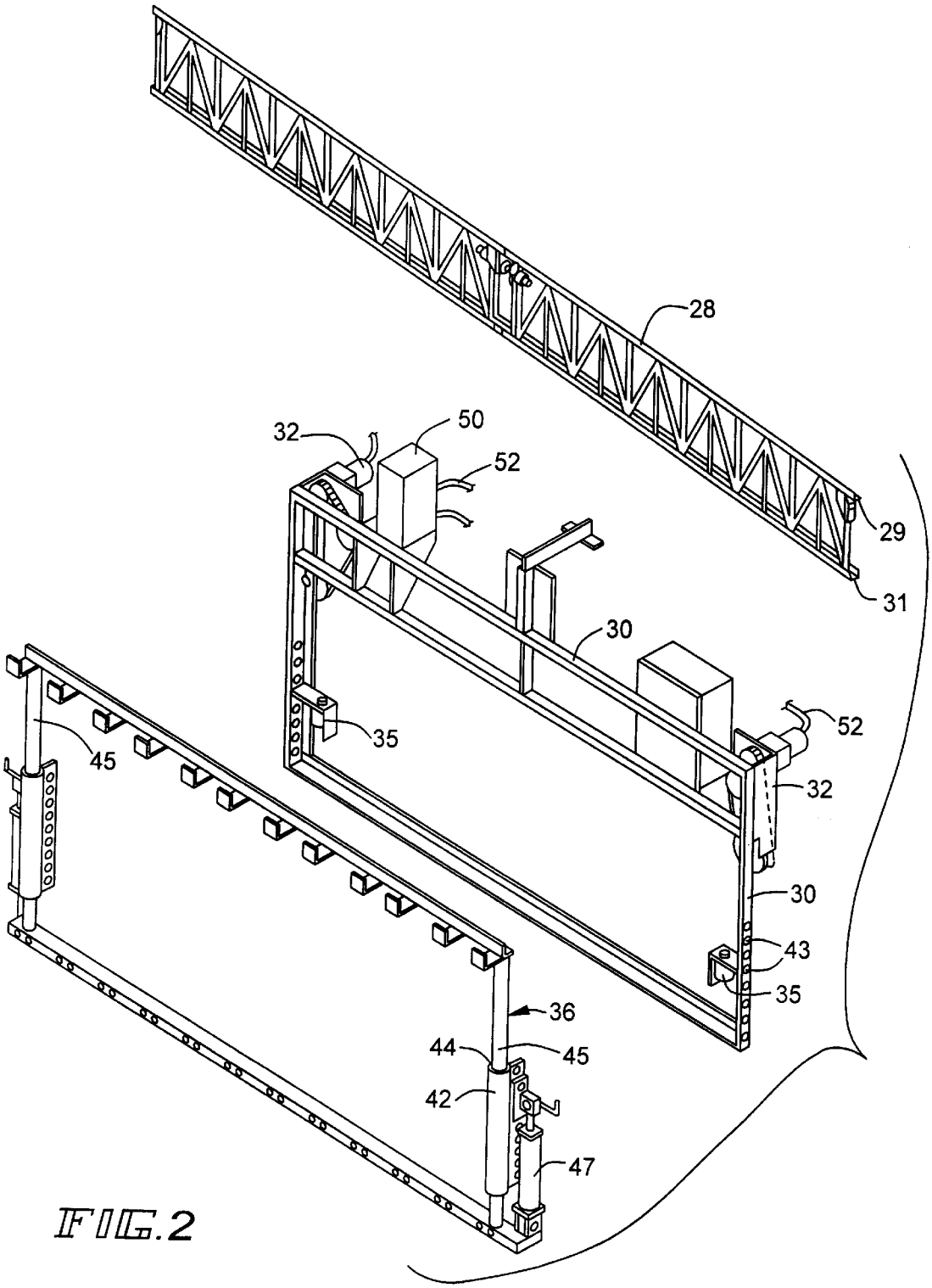
FIG. 2 is a perspective view of the components of the ganged vibrator carriage assembly in accordance with the present invention.

As shown in FIG. 2, mounted to the inner vibrator frame member 30 is a hydraulic motor and tank assembly 50 for driving the hydraulic motors 38 and the cylinders 47 for the ganged vibrator carriage assembly 20. The hose connections 52 from the hydraulic motor 50 are positioned within a hydraulic hose trough 54, as shown in FIGS. 11–13. The hydraulic hose trough 54 permits the hydraulic motor 50 to be coupled to the hydraulic motors 38 which drive the ganged vibrators back and forth across the truss support member frame.

Figure 14:
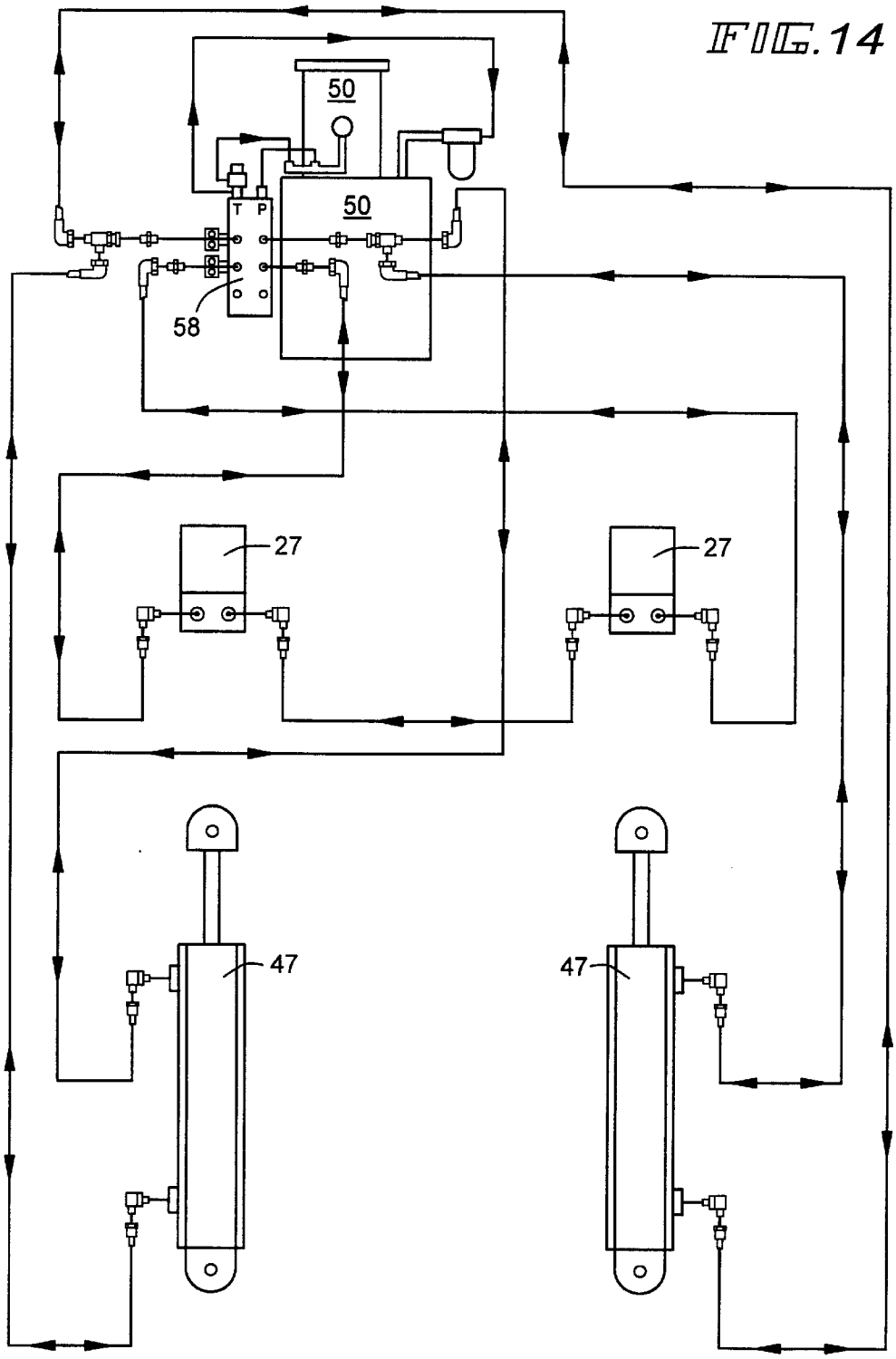
FIG. 14 is a hydraulic diagram showing the controls for the concrete paving machine in accordance with the present invention.

As shown schematically in FIG. 14, the control of the hydraulic motor and tank 50 permits the selective flow of hydraulic fluid through hoses 52 to the left hand and right hand motors 38 which power the ganged vibrator assembly back and forth across the poured concrete surface or deck. Also, the hydraulic motor 50 directly communicates with the left hand and right hydraulic cylinders 47 to raise and lower the ganged vibrator out of and into engagement with the poured concrete. A bank of solenoid valves 58 selectively controls the direction of flow of hydraulic fluid to the motors 38 and to the cylinders 47.

The novel ganged vibrator carriage assembly in accordance with the present invention permits the utilization of a compact hydraulic motor 50 to power each of the motors and cylinders in the assembly. Because of the compactness of the hydraulic motor, the weight of the ganged vibrator carriage assembly as it travels back and forth across the paving machine on the vibrator truss support member frame 28 is substantially reduced which substantially minimizes the distortion and the up and down movement of the concrete paving frame during the finishing operation. This reduced distortion permits the concrete paving machine to maintain a predetermined profile on the finished concrete or deck surface.

Having thus disclosed in detail a preferred embodiment of the invention, persons skilled in the art will be able to modify certain of the structure which has been illustrated and to substitute equivalent elements for those disclosed while continuing to practice the principle of the invention. It is, therefore, intended that all such modifications and substitutions be covered as they are embraced within the spirit and scope of the appended claims.

We claim:

1. A vibrator assembly for use in conjunction with a concrete paving machine, the concrete paving machine being moveable longitudinally along a body of poured concrete, with the paving machine having a machine frame and a finishing carriage unit moveable transversely back and forth across the body of concrete, said vibrator assembly including in combination a plurality of support members mounted to the paving machine frame and having extension members structurally arranged to move between a collapsed position and an extended position forwardly of the machine frame;

a vibrator truss support frame member mounted to the distal ends of said extension members and moveable therewith between said collapsed position and said extended position; and a ganged vibrator carriage assembly mounted to said vibrator truss support frame member and structurally arranged to move transversely back and forth across the body of concrete, said ganged vibrator carriage assembly having a plurality of vertically mounted vibrator units which are structurally arranged to engage the body of poured concrete to vibrate and settle the same, with said plurality of vertically mounted vibrator units being moveable between a downward position wherein said vibrator units engage the poured concrete and an upward position wherein said vibrator units are out of contact with the surface of the concrete.

2. The concrete vibrating apparatus in accordance with claim 1, wherein said plurality of vertically mounted vibrator units is comprised of at least six vibrator units.

3. The concrete vibrating apparatus in accordance with claim 1, wherein said vibrator units are hydraulically driven.

4. The concrete vibrating apparatus in accordance with claim 1, wherein said plurality of support members are each comprised of an outer leg support member mounted to the paving frame and an inner leg support member coaxially mounted thereto and operable between said collapsed and said extended positions.

5. The concrete vibrating apparatus in accordance with claim 4, wherein said inner leg support member is structurally arranged to be moved between said collapsed position and said extended position by a horizontal adjustment mechanism comprised of a rotating feed screw engagable with said inner leg support member to move said inner leg support member between said collapsed and said extended positions.

6. The concrete vibrating apparatus in accordance with claim 5, wherein said rotating feed screw is powered by a bi-directional leg motor.

7. The concrete vibrating apparatus in accordance with claim 4, wherein said plurality of support members are comprised of four support members spaced across the paving frame.

8. The concrete vibrating apparatus in accordance with claim 7, wherein said outer two support members are mounted adjacent the ends of the paving frame and the remaining two support members are mounted substantially at the midpoint of the paving frame.

* * * * *

UNITED STATES PATENT AND TRADEMARK OFFICE

CERTIFICATE OF CORRECTION

PATENT NO. : 6,234,713 B1
DATED : May 22, 2001
INVENTOR(S) : Murray A. Rowe, Frederick A. Blom and Dean A. Johnson It is certified that error appears in the above-identified patent and that said Letters Patent is hereby corrected as shown below:

Column 5,
Line 29, delete the number "2b" and insert -- 28 --.

Signed and Sealed this

Eighth Day of January, 2002

*Attest:*

*Attesting Officer*

JAMES E. ROGAN
*Director of the United States Patent and Trademark Office*